US011753794B2

(12) United States Patent
Stuart et al.

(10) Patent No.: US 11,753,794 B2
(45) Date of Patent: Sep. 12, 2023

(54) SINGLE POINT LIFTING STRUCTURE FOR A WORK MACHINE

(71) Applicant: Caterpillar Inc., Peoria, IL (US)

(72) Inventors: Hadley Stuart, Peoria, IL (US); Brad Lancaster, Raleigh, NC (US); Matthew Kalus, Clayton, NC (US); Gerald Fuerst, Cary, NC (US)

(73) Assignee: Caterpillar Inc., Peoria, IL (US)

( * ) Notice: Subject to any disclaimer, the term of this patent is extended or adjusted under 35 U.S.C. 154(b) by 569 days.

(21) Appl. No.: 16/780,376

(22) Filed: Feb. 3, 2020

(65) Prior Publication Data

US 2021/0238825 A1 Aug. 5, 2021

(51) Int. Cl.

| | |
|---|---|
| ***E02F 9/00*** | (2006.01) |
| ***E02F 3/28*** | (2006.01) |
| ***B66C 1/22*** | (2006.01) |
| ***E02F 9/08*** | (2006.01) |
| ***E02F 9/16*** | (2006.01) |

(52) U.S. Cl.

CPC ..... *E02F 9/003* (2013.01); *B66C 1/22* (2013.01); *E02F 3/28* (2013.01); *E02F 9/0808* (2013.01); *E02F 9/16* (2013.01)

(58) Field of Classification Search

None

See application file for complete search history.

(56) References Cited

U.S. PATENT DOCUMENTS

| | | | | | |
|---|---|---|---|---|---|
| 2,818,296 | A * | 12/1957 | Brennan | B66C 1/20 | 294/67.4 |
| 2,987,340 | A * | 6/1961 | Mattera | B66C 1/20 | 294/81.2 |
| 3,021,166 | A * | 2/1962 | Kempel | B66C 1/20 | 294/81.5 |
| 3,599,813 | A * | 8/1971 | Totz | E02F 9/24 | 280/756 |
| 4,329,109 | A | 5/1982 | Den Bleyker | | |
| 4,553,719 | A * | 11/1985 | Ott | B64D 9/00 | 294/81.54 |
| 5,445,300 | A * | 8/1995 | Eipper | B60R 9/06 | 224/538 |
| 8,602,679 | B2 | 12/2013 | Roetsch et al. | | |
| 2017/0314229 | A1* | 11/2017 | Capraro | E02F 9/16 | |

FOREIGN PATENT DOCUMENTS

| | | | | |
|---|---|---|---|---|
| CN | 203699662 U | | 7/2014 | |
| CN | 108455444 A | * | 8/2018 | B66C 1/22 |

* cited by examiner

*Primary Examiner* — Michael S Lowe

(57) ABSTRACT

In accordance with one aspect of the present disclose, a lift apparatus for a work machine is provided. The lift apparatus may have a horizontally disposed lift frame that has a mount on its top surface. The lift apparatus may further include a first elongated member having a first end and a second end. The first elongated member is vertically disposed and attached to a first side of the lift frame at the first end, and the second end includes a first attachment point for attaching to the work machine. The lift apparatus further includes a second elongated member that has a first end and a second end, the second elongated member is vertically disposed and attached to a second side of the lift frame at the first end, and the second end includes a second attachment point for attaching to the work machine.

13 Claims, 8 Drawing Sheets

SINGLE POINT LIFTING STRUCTURE FOR A WORK MACHINE

TECHNICAL FIELD

The present disclosure generally relates to work machines and, more particularly, relates to a lift apparatus associated with work machines.

BACKGROUND

Small wheel loaders are a type of work machine and generally include a machine frame, four wheels, and a cab mounted on the machine frame. The work machine includes a tool to scoop, or move/push, material from the ground, such as dirt, sand, or gravel, for transporting to a discharge location. The tool typically is connected to two booms that are connected to the machine frame, and the cab is adapted to protect the operator from the environment and often includes a door and front and side windows. In operation, work machines often need to be lifted into a work site. For example, small wheel loaders are used to unload the contents of large barges. To be positioned within a barge, the machines are lifted by a large crane or hoist, which are often connected to multiple points on the machine frame, or the machines are placed on platform connected to a crane.

Chinese Patent Publication No. 203699662 U, entitled "Novel Lifting Frame for Coiled Reinforced Bar and Wire Rod," and assigned to Beijing Uni Construction Group, discloses a lifting structure. The lifting structure of the Chinese '662 patent application publication includes a structure that is in the shape of a 'C', and the structure can be lifted from its top on which the center of mass lies.

U.S. Pat. No. 8,602,679, entitled, "Construction Machine, In Particular Road Construction Machine, for Example Tandem Roller, Having a Vibration-Decoupled Operator Platform Structure and Having a Hitch Device," discloses a lifting device. The lifting device is arranged on a platform structure of a construction machine. This device allows lifting of machines by a single point suspension.

However, there is still a need for an effective way to lift a machine from a single point that does not interfere with the cab.

SUMMARY

In one aspect, the present disclosure relates to a lift apparatus for a work machine. The lift apparatus may have a horizontally disposed lift frame that has a mount on its top surface. The lift apparatus may further include a first elongated member having a first end and a second end. The first elongated member is vertically disposed and attached to a first side of the lift frame at the first end, and the second end includes a first attachment point for attaching to the work machine. The lift apparatus further includes a second elongated member that has a first end and a second end, the second elongated member is vertically disposed and attached to a second side of the lift frame at the first end, and the second end includes a second attachment point for attaching to the work machine. The second end of the first elongated member may curve towards a front side of the lift frame, and the second end of the second elongated member may also curve towards the front side of the lift frame.

In another aspect, the present disclosure relates to a work machine having a machine frame, one or more wheels, a cab, a tool attached to the frame by one or more booms, and a lift apparatus. The lift apparatus may further include a horizontally disposed lift frame including a mount on its top surface, and a first and a second elongated member each having a first end and a second end that curves towards a front side of the lift frame. The first elongated member is vertically disposed and attached to a first side of the lift frame at its first end, and the second end includes a first attachment point for attaching to the machine frame. The second elongated member is vertically disposed and attached to a second side of the lift at its first end, and the second end includes a second attachment point for attaching to the work machine.

Further, one aspect of the present disclosure may include a method of lifting a work machine. The method includes providing a work machine that has a machine frame, a cab, and a lift apparatus. The lift apparatus includes a horizontally disposed lift frame including a mount on its top surface, and a first and a second elongated member each having a first end and a second end. The first elongated member is vertically disposed and attached to a first side of the lift frame at its first end, and the second end curves towards a front side of the lift frame and includes a first attachment point for attaching to the machine frame. The second elongated member is vertically disposed and attached to a second side of the lift frame at its first end, and the second end curves towards the lift frame front side and includes a second attachment point for attaching to the machine frame. The first and second elongated members may be curved as at their respected second ends. The method further includes attaching an attachment device to the mount, the attachment device may be coupled to a lifting device.

These and other aspects and features of the present disclosure will be more readily understood when read in conjunction with the accompanying drawings.

While the present disclosure is susceptible to various modifications and alternative constructions, certain illustrative embodiments thereof will be shown and described in detail. The disclosure is not limited to the specific embodiments disclosed, but instead includes all modification, alternative constructions, and equivalents thereof.

DETAILED DESCRIPTION

Figure 1:
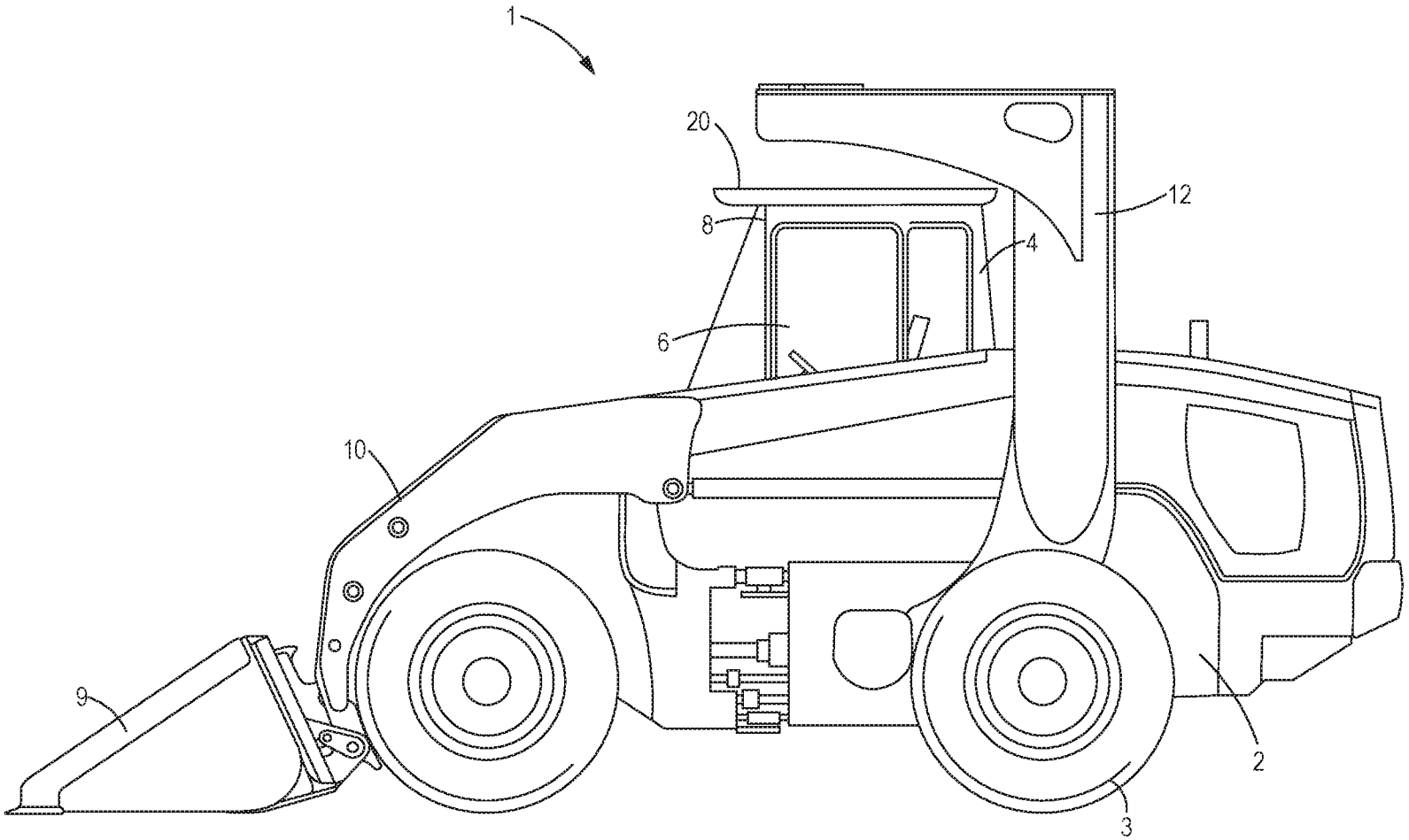
FIG. 1 is a side view of a work machine, in accordance with one embodiment of the present disclosure.

Referring now to the drawings, and with specific reference to FIG. 1, a work machine consistent with certain embodiments of the present disclosure is generally referred to by reference numeral 1. Although the work machine 1 is illustrated as a small wheel loader, the work machine 1 is shown primarily for illustrative purposes to assist in disclosing features of various embodiments, in that FIG. 1 does not depict all of the components of a work machine. Moreover, the readings of this disclosure can be employed on other earth moving and construction machines as well.

The work machine 1 may comprise a machine frame 2 supported by the wheels 3. Although the wheels 3 are shown, other support and movement devices (not shown) may be tracks or of any other type. Mounted on the frame 2 may be a cab 4 in which the operator of the work machine 1 sits. The cab may include a door 6 to allow the operator to enter the cab 4, or a window 8 for the operator to see through the window 8 for operation of the work machine 1. The work machine 1 may further include a tool 9 connected to the machine frame 2 by one or more booms 10. As an example, the tool 9 may be a bucket loader configured to move or load materials such as asphalt, demolition debris, snow, feed, gravel, logs, raw minerals, recycled rock, or sand. Also shown is the lift apparatus 12 for providing a single point lifting structure.

As best shown in FIG. 1, the lift apparatus 12 is attached to the frame 2 of the work machine. In the FIG. 1 embodiment, the lift apparatus 12 is attached to both side of the frame below the operator cabin and is shaped to extend upwardly away from blocking the window 8 and the door 6 of the cab 4. This allows an operator to enter the door 6 of the cab without it being blocked by the lift apparatus 12, and see through the window 8. Further, by being attached to the frame 2 of the work machine 1, the lift apparatus 12 is able to support the full weight of the work machine 1 when the work machine 1 is lifted at the lift apparatus 12.

Referring to FIGS. 2-8, with continued reference to FIG. 1, the lift apparatus 12 may comprise a horizontally disposed lift frame 20. As shown, the lift frame 20 is square shaped, but any shape capable of avoiding contact with the cab's door 6, or blocking view through the window 8 by an operator, may be used. A first elongated member 22 and a second elongated member 24 are vertically disposed and extend downward from the lift frame 20. As shown best in FIG. 2, the first and second elongated members may be curved shaped as to allow for avoidance of contact of the lift apparatus 12 and the cab 6, and to allow the operator to open the cab's door 8 without the lift apparatus 12 blocking the entrance. This allows for operation of the work machine 1 with the lift apparatus 12 attached.

In some exemplary embodiments, there is between 1 and 2 feet clearance between a roof of the cab 4 and the lift frame 20, allowing for full operation of the vehicle without contact. In another embodiment, the clearance between the roof of the cab 4 and the lift frame can be less than a foot or more than two feet.

Figure 2:
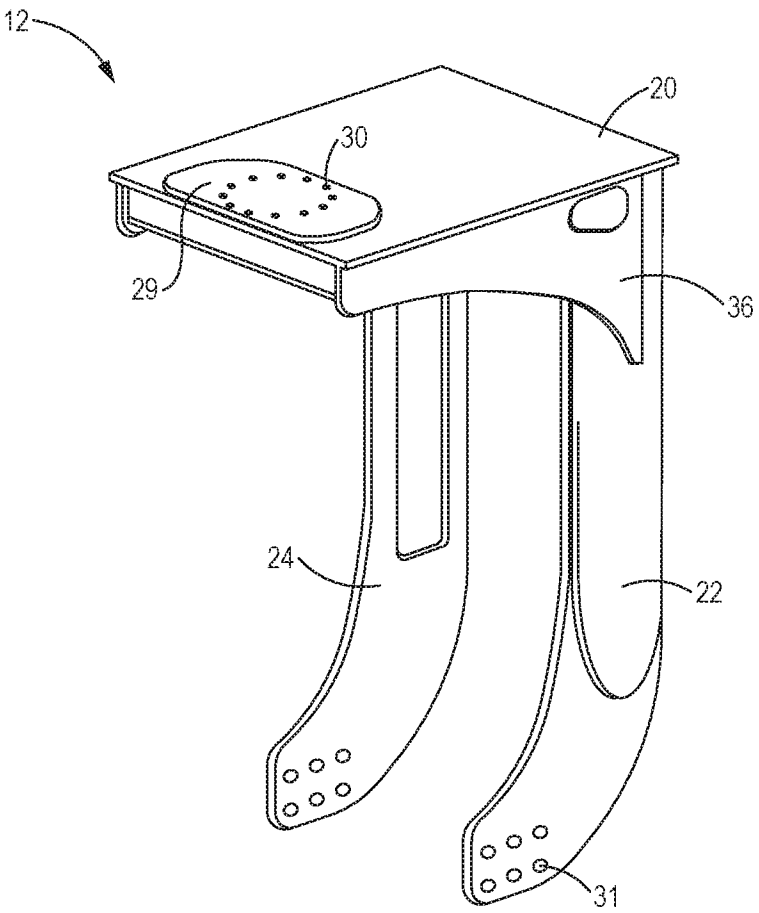
FIG. 2 is a diagrammatic view of a lift apparatus for the work machine of FIG. 1.

A mount 29 is located on the lift frame 20. The mount 29 is configured to provide a location to lift the work machine 1, and this lifting may be done by lifting devices such as a crane or a hoist (not shown). For example, in one exemplary embodiment the hook (not shown) of a crane may be configured to attach to the work machine 1 at the mount 29 to lift the work machine 1. The mount 29 may include bolt holes, such as bolt hole 30, for attachment of a lifting attachment 50 (discussed below). The mount 20 is shown in FIG. 2 and with a 12 bolt hole 30 circle pattern for attachment of the lifting attachment, such as lifting attachment 50, with bolts. These bolt holes 30 allow for the attachment of a lifting attachment 50 that may connect directly to the crane or hoist. The bolt hole 30 pattern, in some embodiments, may include a 6, 12, or other amount, bolt hole 30 pattern. By having a multiple bolt hole 30 configuration, many different lifting attachments 50 from different manufacturers, and used by different lifting devices, may be attachable at the mount 29.

FIG. 2 further illustrates a first attachment point 31 on the first elongated member 22. However, FIG. 3 best illustrates a second attachment point 32 on the second elongated member 24. As shown, the second attachment point 32 is located on a second end 33 of the second elongated member 24, and on a first end 34 of the second elongated member 24 the second elongated member 24 connects with the lift frame 20. The first attachment point 31, and the second attachment point 32, are shown including bolt pass through holes 30 in the figures for attaching the lift apparatus 12 to the machine frame 2 of the work machine 1. However, in another exemplary embodiment, the lift apparatus 12 may be welded, or attached by other means, to the machine frame 2 at the attachment points.

Figure 3:
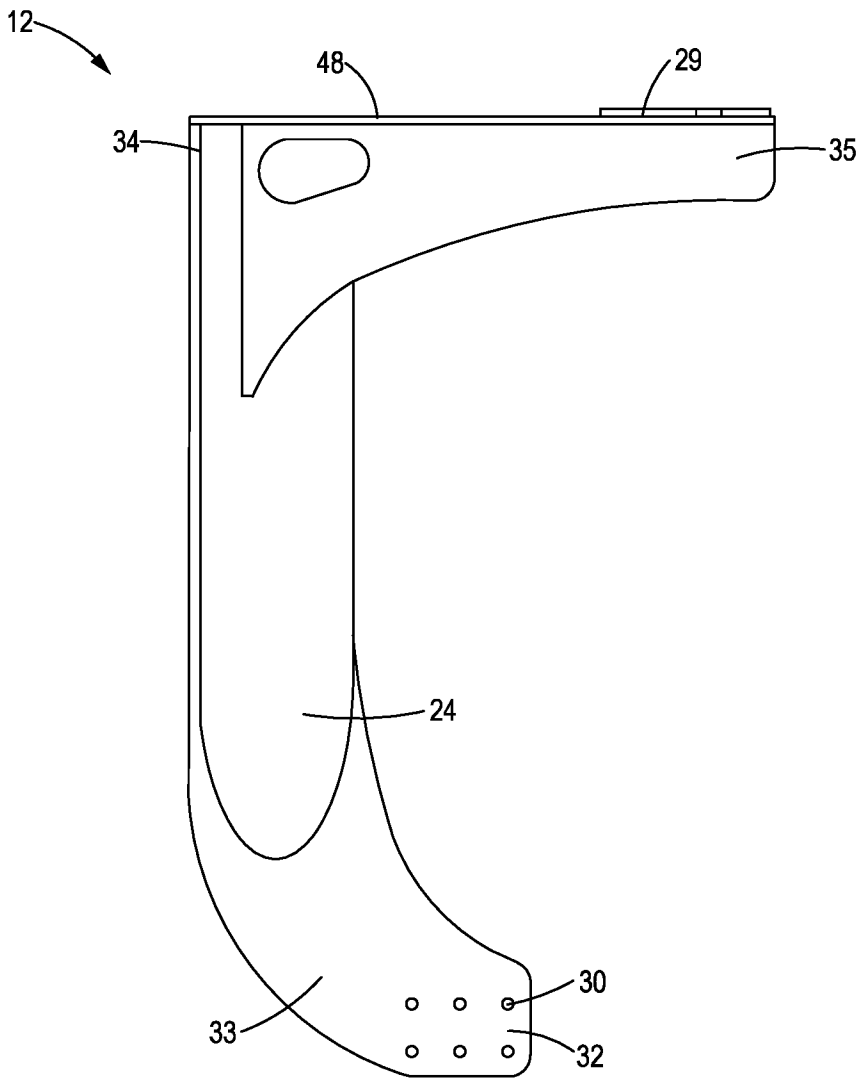
FIG. 3 diagrammatic side view of the lift apparatus for the work machine of FIG. 1, according to aspects of the present disclosure.

Further shown in FIG. 3 is the second side support 35, and a first side support 36 is shown FIG. 2. These side supports are used to support the attachment of the lift frame 20 to the first elongated member 22 and second elongated members 24, and strengthen the structure of the lift apparatus 12 when the work machine 1 is lifted at the mount 29. As shown, the first side support 36 is coupled to an under side of the lift frame 20, and it expands from a narrow width towards a wider width near the first elongated member 22, forming an arch shape in doing so. In other embodiments, the first side support 36 and the second side support 35, are not arch shaped but may be rectangular, or any shape capable of providing support and strengthening the structure of the lift frame 20.

Figure 4:
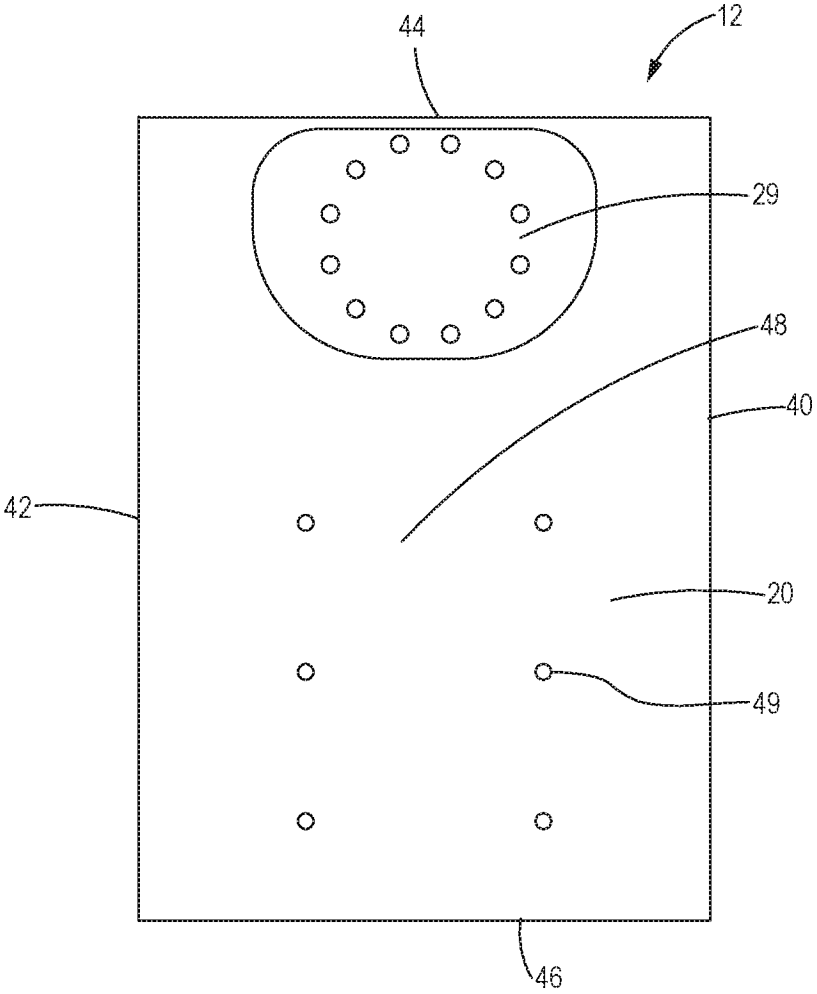
FIG. 4 is a diagrammatic top view of the lift apparatus for the work machine of FIG. 1.

The lift frame 20 may have a second side 40, a first side 42, a front side 44, and a rear side 46. The lift frame 20 may further include a top surface 48. As shown in FIG. 4, the mount 29 is located towards the front side 44 of the lift frame 20, and on its top surface 48. In one non-limiting exemplary embodiment, the mount 29 is aligned with the center of mass of the work machine 1. It will be appreciated that the lifting should be from approximately above the center of mass of the work machine 1 in order to minimize undesirable stresses during a lifting operation, particularly lateral forces on the elongated members.

Further illustrated in FIG. 4, are the holes 49. The FIG. 4 exemplary embodiment illustrates a six hole 49 pattern, but more or less holes may be utilized in other examples. The holes 49 on the top surface 48 of the lift frame 20 may have many uses, including an additional mounting point for lifting the work machine 1, or an attachment point for other peripherals of the work machine 1, such as lights or other tools.

Figure 5:
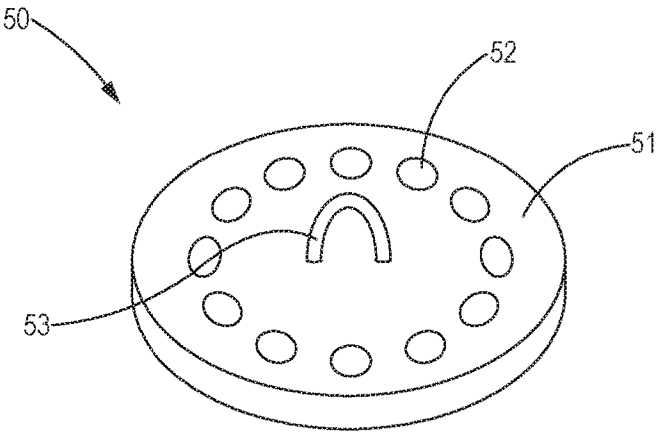
FIG. 5 is a diagrammatic view of a lifting attachment, according to aspects of the present disclosure.

Illustrated in FIG. 5 is the lifting attachment 50. The lifting attachment 50 may take many forms but serves to attach to the mount 29 of the lifting apparatus 12 during a lifting operation of the work machine 1. As shown, in one exemplary embodiment the lifting attachment 50 may take the form of a circular disk shaped plate 51 having a pattern of bolting holes 52. As shown, is a 12 bolting hole 52 pattern that matches the bolt hole 30 pattern on the mount 24, but it may contain more or less bolting holes. The bolting holes 52 allow for the bolting of the lifting attachment 50 to the mount 29, but it may be attached by other means, such as welding, in another embodiment. The mount 29 may contain one or more bolt holes 30, that may be in a bolt hole pattern, that forms a single point attachment for the lifting attachment 50. This single point attachment of the lifting attachment 50 to the mount 29 further allows for a single point lifting operation of the work machine 1 at the single point attachment.

Figure 6:
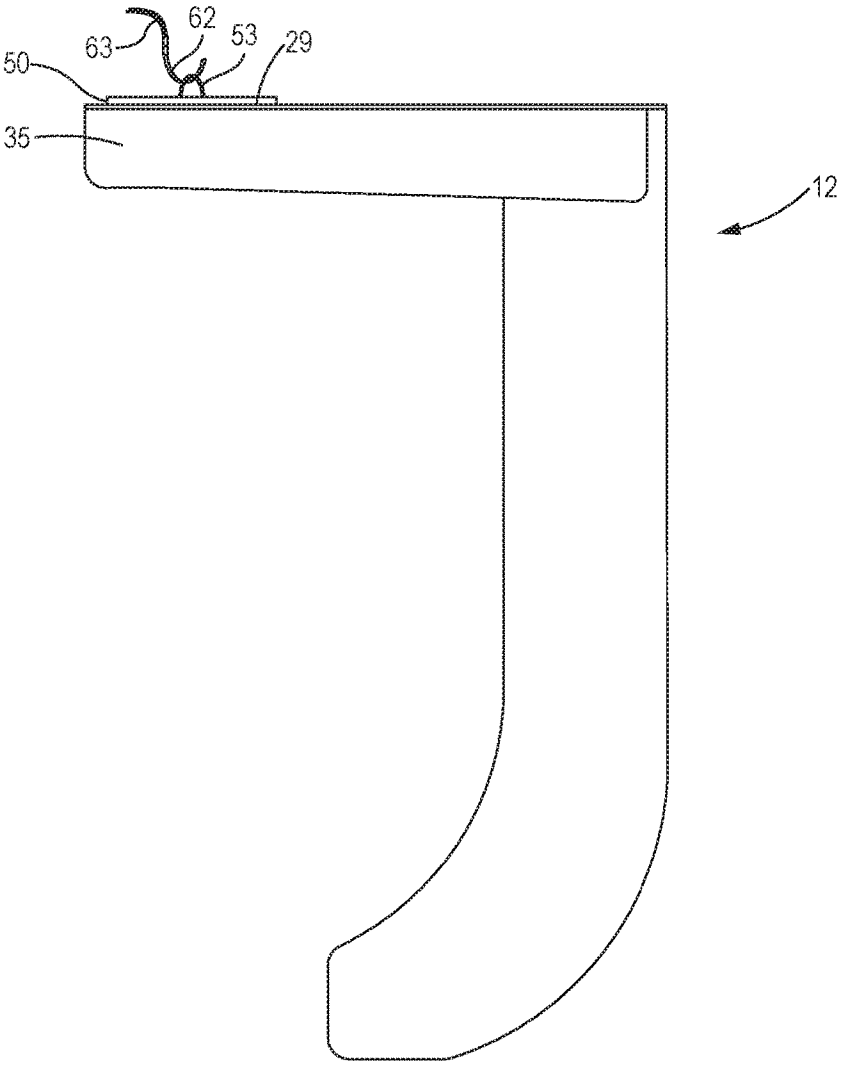
FIG. 6 is a diagrammatic side view of a lift apparatus attached to the lifting, in accordance with an exemplary embodiment of the present disclosure.

The lifting attachment 50 may further include an attachment ring 53 to allow for the lifting of a work machine 1. As best shown in FIG. 6, the lifting apparatus 12 may be attached to the lifting attachment 50 at the mount 29. The attachment ring 53 allows for a hook 62 attached to a hoist 63 of a crane (not shown), and for the lifting of the work machine 1 at the point where the lifting attachment 50 is attached to the mount 29.

Figure 7:
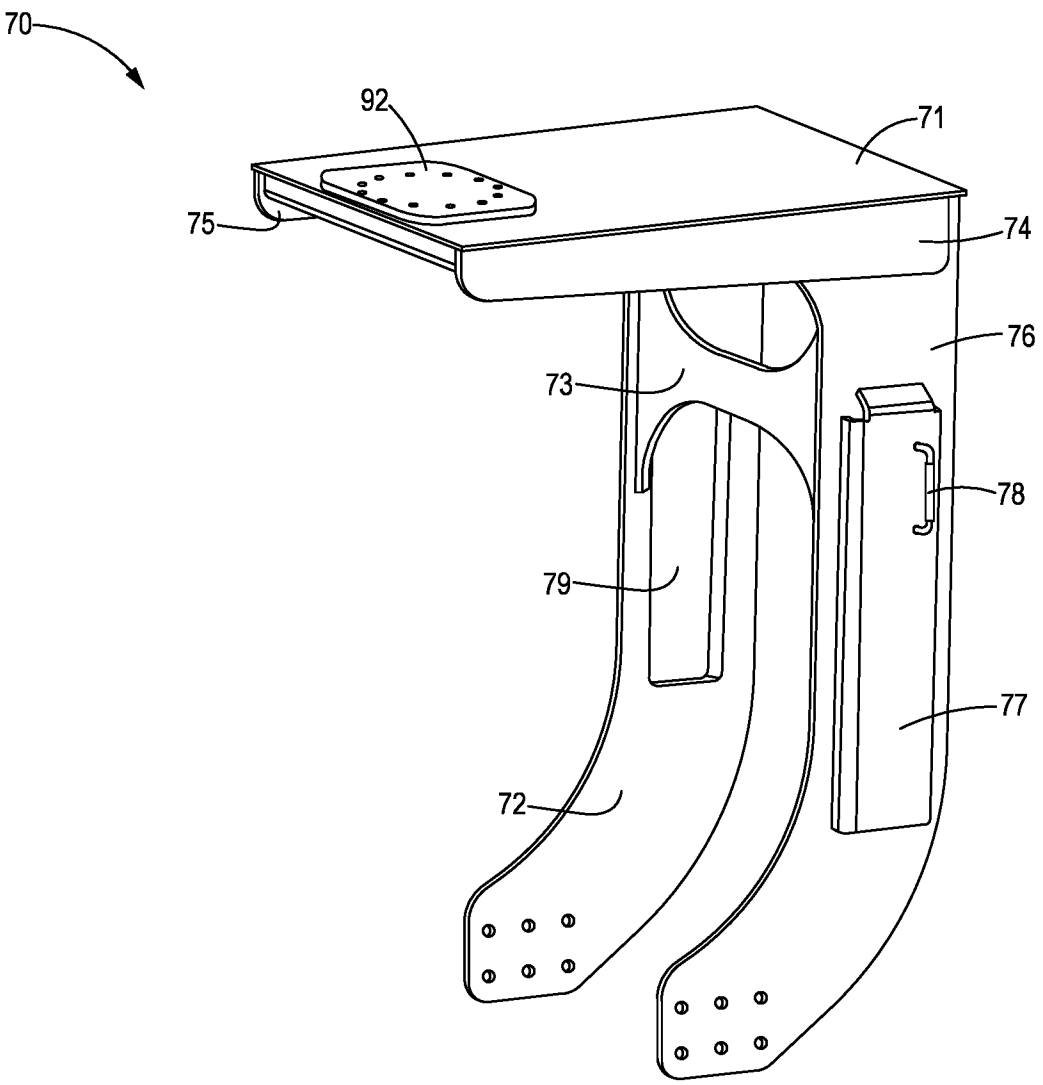
FIG. 7 is a diagrammatic view of a lift apparatus for a work machine in accordance with another embodiment of the present disclosure.

A second exemplary 70 embodiment of a lift structure is illustrated in FIG. 7. The vertically disposed lift structure is shown including a lift frame 71 that includes a mount 92. The life frame has a first vertically disposed elongated member 76 and a second vertically disposed elongated members 72. The lift frame 71 includes a top mount 76, as well as a first side support 74 and a second side support 75. Disposed between the first elongated member 76 and the second elongated member 72 is shown support bar 73 to strengthen the structure. The first elongated member 76 includes a side structure 77 that includes a handle 78. In one example, the first elongated member's 76 first side structure 77 is attached to the first elongated member 76, but in another example the first elongated member 76 and the first side structure 77 may be one piece. The second elongated member 72 may further include a second side structure 79 similar to the first side structure 77.

Figure 8:
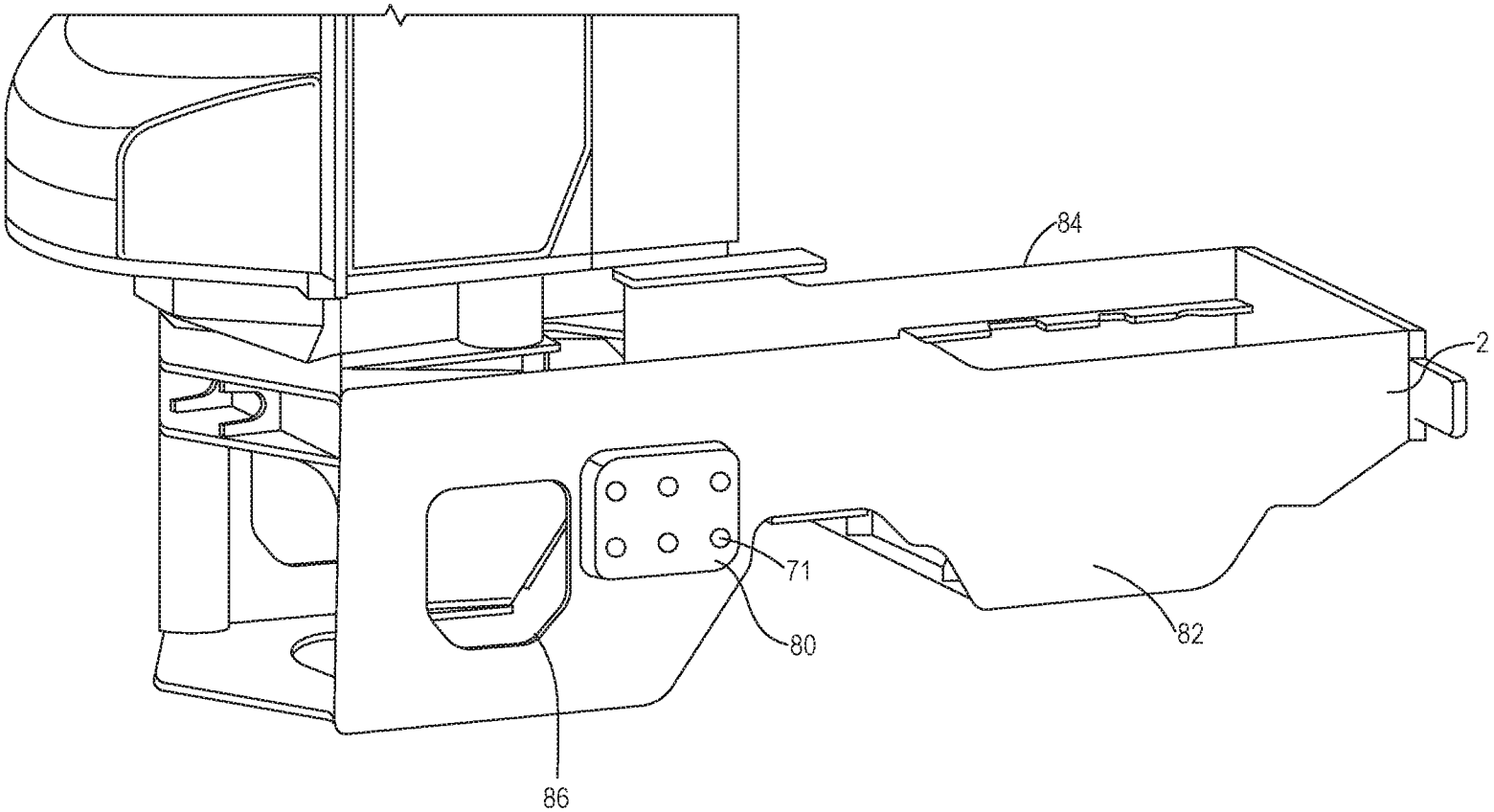
FIG. 8 is a diagrammatic illustration of an exemplary machine frame according to aspects of the present disclosure.

The machine frame 2, in one embodiment, may include one or more attachment plates 80 for attachment of the first elongated member 22 and the second elongated member 24. In FIG. 8, a first attachment plate 80 is located on a first side 82 of the machine frame 2, and a second attachment plate (not shown) is located on a second side 84 of the machine frame 2, similarly to the first attachment plate 80. In another exemplary embodiment, the attachment plates 80 are welded onto the machine frame 2, and the first 22 and second 24 elongated members are bolted onto the their corresponding first 80 and second attachment plates at the first attachment point 31 and the second attachment point 32, respectively. The first attachment plate 80 is shown in the FIG. 8 view having bolt attachment hole 71, to align and attach the first elongated member 22 with the attachment plate 80. The attachment plate 80 may contain as many bolt attachment holes 71 as there are in the corresponding attachment point 31, but in another embodiment, may contain a different number. Further, other attachment means, such as welding, may be utilized instead of bolting.

FIG. 8 further illustrates an access hole 86 towards a front side of the machine frame 2. This access hole allows for the maintenance of the work machine 1. In one example, around every 500 hours, a maintenance servicer must receive check the hydraulic system oil filter and the transmission oil, both of which are accessible through hole 86. However, due to the installation of the first attachment plate 80, the original engine cover (not shown) covering access hole 86 may need to be replaced with new cover plates.

INDUSTRIAL APPLICABILITY

In general, the foregoing disclosure finds utility in various applications, such as, in earthmoving, construction, industrial, agricultural, mining, transportation, and forestry machines. In particular, the disclosed lift apparatus may be used by small wheel loader machines and other applications, such as, a quarry conveyor and the like. By applying the disclosed lift apparatus to a small wheel loader machine, optimum lifting and placement of the work machine may be achieved.

In particular, the disclosed lift apparatus provides a single point in which a single point lifting of the work machine may be achieved. Furthermore, the lift apparatus may be bolted onto the machine frame of the work machine and is designed to be lifted from a single point that is aligned with the center of mass of the machine. This single point may be adapted for use with various couplers. Further, the lift apparatus is designed to minimize interference with the operation of the cab and the engine covers.

Figure 9:
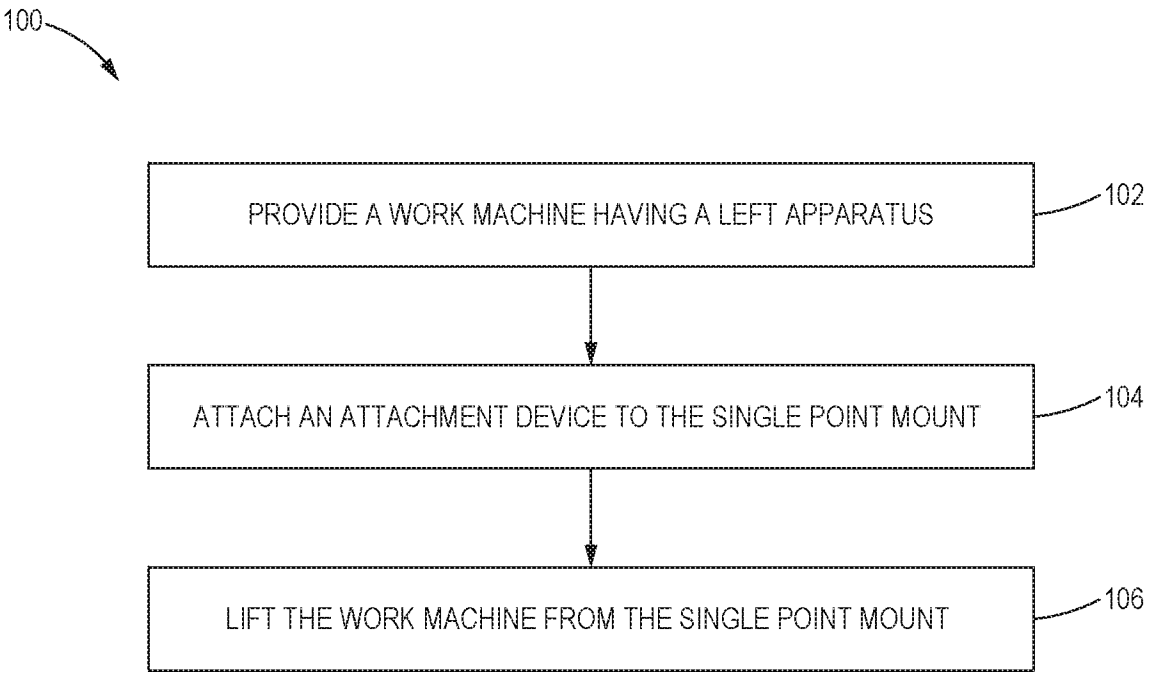
FIG. 9 is a flowchart illustrating an example process for lifting a work machine, according to aspects of the present disclosure.

Turning now to FIG. 9, with continued references to FIGS. 1-8, a flowchart illustrating an example process 100 for lifting a work machine is disclosed. At block 102, a work machine 1 having a lift apparatus 12 is provided. The lift apparatus 12 may be retrofitted on existing work machines 1, or may come installed on the work machine 1 from the factory. If retrofitted, some modifications of the engine covers, and covers located on the machine frame 2, may be required. The work machine also includes a machine frame and a cab that may be located on top of the machine frame 2. The lift apparatus 12 is connected to the machine frame 12 of the work machine 1.

At block 104, an attachment device (not shown) in connected to the mount 29 of the lift apparatus 12. The mount 29 is versatile and provides for a multiple bolt hole configuration that allows for a variety of attachment device couplers to be used.

At block 106, the work machine 1 is lifted from the mount. The lift apparatus 12 wraps around the door and over the cab 4 to provide a location for lifting the work machine 1 from a single point.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A lift apparatus for a work machine, comprising:

a horizontally disposed lift frame including a mount on its top surface;

a first elongated member including:

a first end of the first elongated member, and a second end of the first elongated member, the first elongated member being vertically disposed and attached to a first side of the horizontally disposed lift frame at the first end of the first elongated member, and the second end of the first elongated member including a first attachment point; and a second elongated member including:

a first end of the second elongated member, and a second end of the second elongated member, the second elongated member being vertically disposed and attached to a second side of the horizontally disposed lift frame at the first end of the second elongated member, the second end of the second elongated member including a second attachment point, the second end of the first elongated member curving towards a front side of the horizontally disposed lift frame, the second end of the second elongated member curving towards the front side of the horizontally disposed lift frame, the first attachment point being configured to attach to a first portion, of a machine frame of the work machine, that is on a first side of the machine frame and below a cab of the work machine, and the second attachment point being configured to attach to a second portion, of the machine frame, that is on a second side of the machine frame and below the cab of the work machine.

2. The lift apparatus of claim 1, in which the mount is configured to provide a location to lift the work machine.

3. The lift apparatus of claim 2, in which the mount is configured to be bolted to a lifting attachment.

4. The lift apparatus of claim 2, in which the mount includes a six hole bolt pattern.

5. The lift apparatus of claim 3, in which the lifting attachment is configured to be attached to a hook of a crane or a hoist.

6. The lift apparatus of claim 1, in which the mount forms a single point attachment for a lifting attachment, the single point attachment including at least one bolt hole.

7. The lift apparatus of claim 1, further comprising a first side support coupled to the first side of the lift apparatus, and a second side support coupled to the second side of the lift apparatus.

8. The lift apparatus of claim 1, wherein the second end of the first elongated member is configured to avoid contact of the lift apparatus and the cab via the second end of the first elongated member curving towards the front side of the horizontally disposed lift frame.

9. The lift apparatus of claim 1, wherein the first end of the first elongated member and the first end of the second elongated member are configured to provide a range of 1 to 2 feet of clearance between the cab and the horizontally disposed lift frame.

10. A work machine, comprising:

a machine frame;

at least one wheel;

a cab including a door and a window, the window located on a front side of the cab; and a lift apparatus including, a lift frame including a mount on its top surface, a first elongated member including:

a first end of the first elongated member, and a second end of the first elongated member, the second end of the first elongated member being curved in a manner that extends the second end of the first elongated member away from the door, the first elongated member being vertically disposed and attached to a first side of the lift frame at the first end of the first elongated member, and the second end of the first elongated member including a first attachment point that is attached to a first portion, of the machine frame, that is on a first side of the machine frame and below the cab; and a second elongated member including:

a first end of the second elongated member, and a second end of the second elongated member, the second elongated member being vertically disposed and attached to a second side of the lift frame at the first end of the second elongated member, and the second end including a second attachment point, that is attached to a second portion, of the machine frame, that is on a second side of the machine frame and below the cab.

11. The work machine of claim 10, in which the first attachment point is attached to the first portion of the machine frame by directly coupling to an attachment plate that is welded to the first side of the machine frame.

12. The work machine of claim 10, in which the work machine is configured to be lifted at the mount.

13. The work machine of claim 10, in which the mount is aligned with a center of mass of the work machine.

* * * * *